US009004165B2

(12) United States Patent
Abramova et al.

(10) Patent No.: US 9,004,165 B2
(45) Date of Patent: Apr. 14, 2015

(54) METHOD AND ASSEMBLY FOR RECOVERING OIL USING ELASTIC VIBRATION ENERGY

(75) Inventors: Anna Vladimirovna Abramova, Moscow (RU); Vadim Muratovich Bayazitov, Moscow (RU); Andrei Andreevich Pechkov, Moscow (RU)

(73) Assignee: Obschestvo S Ogranichennoi Otvetstvennostju "Sonovita", Moscow (RU)

( * ) Notice: Subject to any disclaimer, the term of this patent is extended or adjusted under 35 U.S.C. 154(b) by 644 days.

(21) Appl. No.: 13/266,491

(22) PCT Filed: Apr. 16, 2010

(86) PCT No.: PCT/RU2010/000177

§ 371 (c)(1), (2), (4) Date: Oct. 27, 2011

(87) PCT Pub. No.: WO2010/126395

PCT Pub. Date: Nov. 4, 2010

(65) Prior Publication Data

US 2012/0043075 A1 Feb. 23, 2012

(30) Foreign Application Priority Data

Apr. 28, 2009 (RU) ..... 2009115817

(51) Int. Cl.
*E21B 28/00* (2006.01)
*E21B 43/00* (2006.01)

(52) U.S. Cl.
CPC ..... *E21B 43/003* (2013.01)

(58) Field of Classification Search
USPC ..... 166/249, 177.1, 65.1, 248, 177.6
See application file for complete search history.

(56) References Cited

U.S. PATENT DOCUMENTS 3,322,196 A * 5/1967 Bodine, Jr. ..... 166/249
4,345,650 A 8/1982 Wesley (Continued)

FOREIGN PATENT DOCUMENTS

| | | |
|---|---|---|
| RU | 2 026 969 | 1/1995 |
| RU | 2 143 554 | 12/1999 |
| RU | 2 162 519 | 1/2001 |
| RU | 2 283 951 | 9/2006 |

OTHER PUBLICATIONS

International Search Report of PCT/RU2010/000177, Oct. 7, 2010.

(Continued)

*Primary Examiner* — Catherine Loikith
(74) *Attorney, Agent, or Firm* — Collard & Roe, P.C.

(57) ABSTRACT

A method and assembly for recovering oil using elastic vibration energy involves placing a downhole apparatus in a well, which downhole apparatus is connected to aboveground power supply units and contains an ultrasonic transducer that provides for the generation of high frequency elastic vibrations, exciting elastic vibrations of different frequencies and then repeatedly applying the elastic vibrations to the oil formation, wherein both high and low frequency vibrations are applied to the formation. The low frequency vibrations are generated with the aid of an electric pulse device which is connected to an aboveground power supply and includes the following electrically interconnected components: a charger, a unit of energy storage capacitors, a discharge unit with electrodes, and two switching devices. The method and assembly make it possible to recover oil from depths of over 2000 meters and to act effectively on the formation being treated.

27 Claims, 7 Drawing Sheets

(56) References Cited

U.S. PATENT DOCUMENTS

Figure 1:
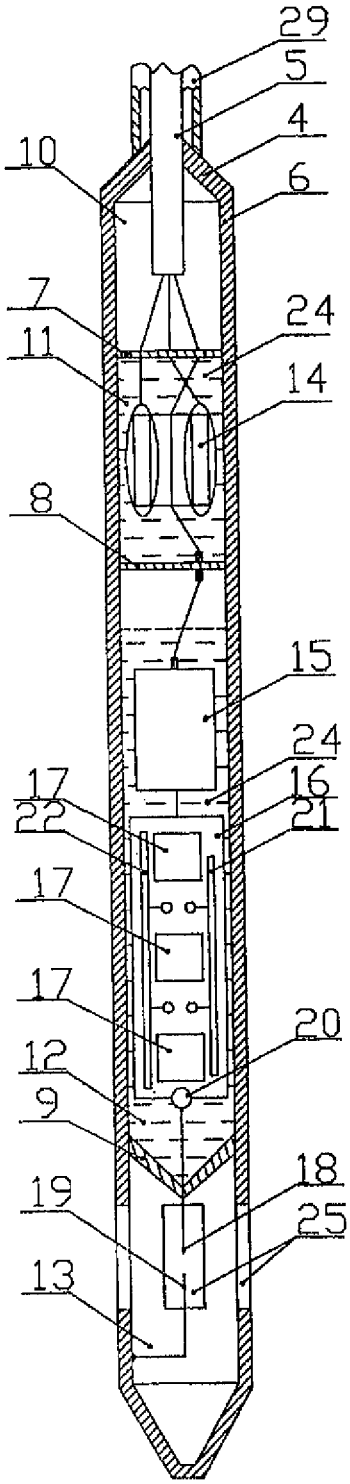

| | | | | |
|---|---|---|---|---|
| 5,184,678 | A | 2/1993 | Pechkov et al. | |
| 5,282,508 | A * | 2/1994 | Ellingsen et al. | 166/249 |
| 6,227,293 | B1 * | 5/2001 | Huffman et al. | 166/248 |
| 6,427,774 | B2 * | 8/2002 | Thomas et al. | 166/248 |
| 7,677,673 | B2 * | 3/2010 | Tranquilla et al. | 299/2 |

OTHER PUBLICATIONS

L.Ia.Popilov "Electro-physical and electro-chemical treatment of materials," Chapter 13 Electro-hydraulic treatment, Jan. 1, 1982, pp. 265-270.

* cited by examiner

METHOD AND ASSEMBLY FOR RECOVERING OIL USING ELASTIC VIBRATION ENERGY

CROSS REFERENCE TO RELATED APPLICATIONS

This application is the National Stage of PCT/RU2010/000177 filed on Apr. 16, 2010, which claims priority under 35 U.S.C. §119 of Russian Application No. 2009115817 filed on Apr. 28, 2009, the disclosure of which is incorporated by reference. The international application under PCT article 21(2) was not published in English.

BACKGROUND OF THE INVENTION

1. Field of the Invention

The invention relates to the field of oil recovery and, more specifically, to the recovery of oil using elastic vibration energy and with rather high efficiency can be applied for recovering of oil from depths of over 2000 meters.

2. Description of the Related Art

The device for pulse impact on oil formation (pool) with a downhole apparatus is known with working idea based on 'electro-hydraulic effect' allowing to increase productivity of oil pool treatment.

In this device downhole apparatus is designed as empty cylindrical body and contains a charger, a unit of energy storage capacitors, a discharge unit with two electrodes and a trigger.

The major disadvantages of this device are: big size of a downhole apparatus (roughly diameter is 250 mm, length—3500 mm) and low energy (not more than 100-300 J) of single discharge of energy storage capacities.

The use of a downhole apparatus with such energy of discharge does not allow to work with depths of over 1500-2000 meters, while vast majority of wells e.g. in Western Siberia of Russian Federation and in Canada have oil formations (pools) on depths of 2500-2700 meters and more and its size makes difficult to work in pipe casing with reduced diameter with varying configuration of sections of pool and limits its move to other wells.

The second (and most important) disadvantage of this device is caused by 'negative constructive features' of a unit of energy storage capacitors.

Normally for increase of discharge energy, capacity energy is increased as discharge energy is equal to half of multiplication of capacity and squared voltage applied. However this leads to considerable size increase of downhole apparatus and makes more difficult use of it.

'Negative constructive features' of the unit of energy storage capacitors of the known device are that capacities both when charging and discharging have parallel electrical connection. Accordingly this approach does not allow to have discharging voltage more than 20 kW (limited by cable working capacity and safety requirements) and does not allow to obtain energy of discharge more than 1 kJ, which is however required (see Paschen curve in the analogue in FIG. 1) for efficient work on considerable depths.

Figure 2:
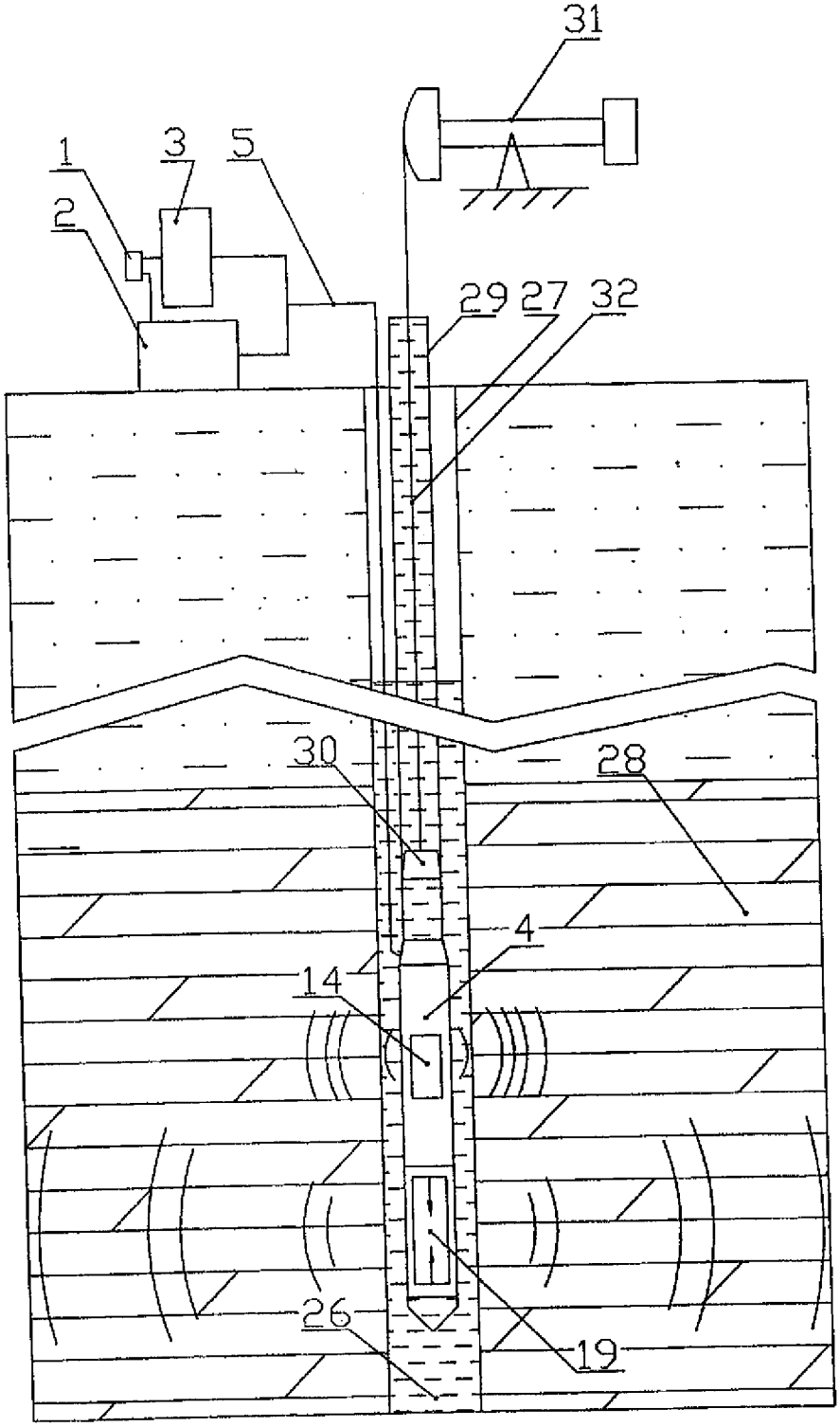
Figure 3:
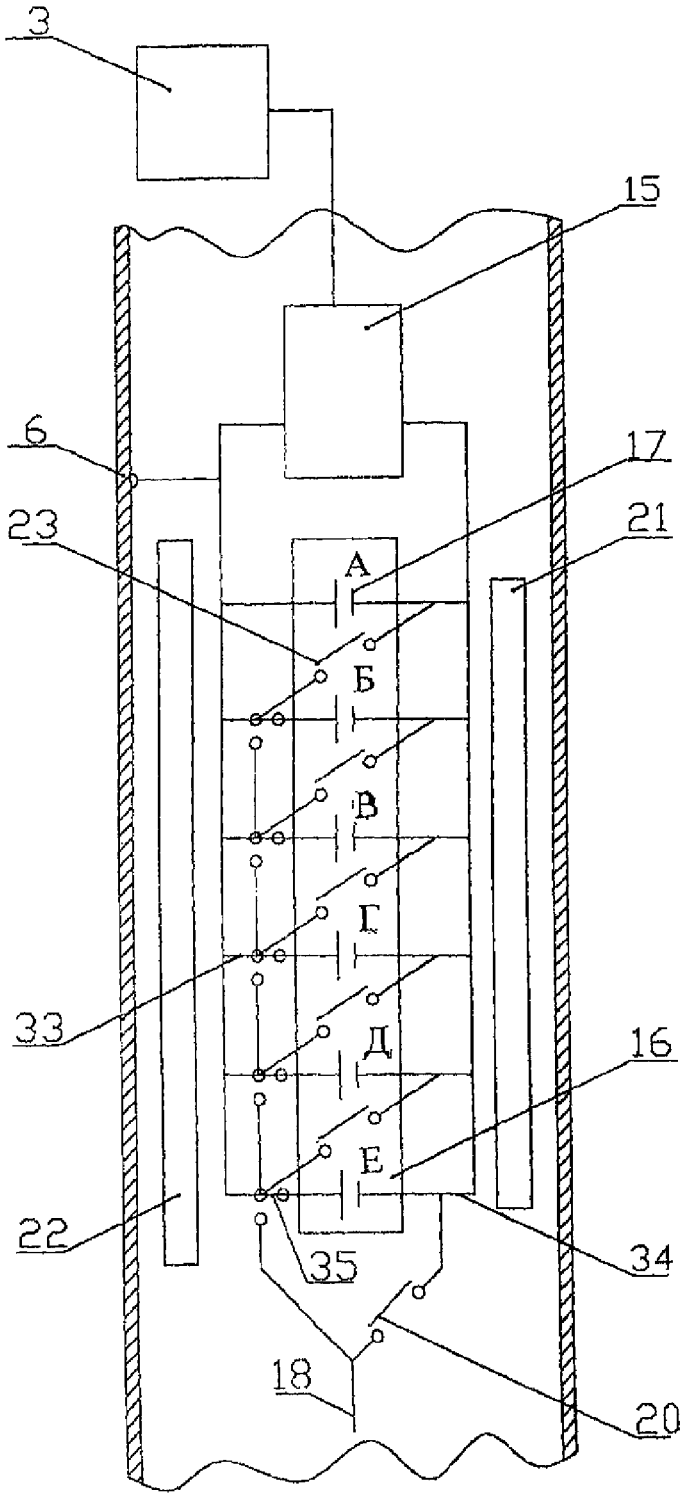

There is no direct note for such (parallel) connection of charging capacities in the description of known invention but available information (see L.la.Popilov 'Electro-physical and electro-chemical treatment of materials' chapter 13 'Electro-hydraulic treatment' pp. 265-270, FIGS. 1, 2 and 3) let us claim that authors of this invention used exactly this well-known and commonly used method for electrical connection of charging capacitors.

Besides, use in this device of electro-hydraulic effect causing elastic vibrations of only low frequency in fluent fraction of oil pool providing treatment of reservoir zone but does not allow to treat with vibration well bottom zone (as high frequency vibration is required), which could increase productivity of treated oil pool. Given disadvantage should be also associated with the method for oil recovery with use of this devise.

It is also known the method of oil recovery using energy of high frequency vibration generated by source of acoustic vibrations [2].

The use of elastic vibrations of high frequency does not prevent from placing of downhole apparatus on depth of 2700 meters but does not allow impacting on critical area of the well (as low frequency vibration is required), that could increase to greater extent productivity of treated oil pool.

This is the major disadvantage of described method of oil recovery and accordingly of the device used for it.

Apart from this, it is know the method for oil discovery using energy of elastic vibration of two frequencies in the range of 10-60 kHz including placing in a well on the working depth of downhole apparatus, initiation of elastic vibrations of various frequencies followed by mainly multiple impact with elastic vibrations of various frequencies on oil pool. This method is realized with use of the device in which downhole apparatus is connected to aboveground power supply and contains one ultrasonic emitting piezoelectric transmitter having rather narrow gain-frequency characteristic and providing generation of elastic vibrations of high frequency on its resonance frequency.

However this assembly (device) and, accordingly, based on its use the method for oil recovery with impact of elastic vibration on oil pool, which in its technical essence is closet to the invention and is used as the prototype, have a range of major disadvantages.

First, non-linearity of porous environment containing fluid may be not sufficient for conversion of pulse emission of piezoelectric transmitter pulsation of low frequency. Besides, as maximum amplitude of high-frequency vibrations remains the same and in case of pulsation is 103 times less than high frequency, intensity of emission of low-frequency will be 106 times less than the one of high frequency, which is obviously not enough for having any impact on pool. So, the use of one piezoelectric transmitter in different options of its stimulation does not allow to obtain elastic vibration of low frequency. Therefore, the known method and the known device with use of piezoelectric transmitter (authors of the known invention mention only piezoelectric transmitter) do not provide treatment of required area of a well.

Second, proposed by the authors of known invention impact by elastic vibrations of low frequency in the range of 10-15 kHz and impact by elastic vibration of high frequency in the range above 44 kHz are not optimal for treatment of oil pool.

Third, the known device does not provide and the known method does not take into consideration simultaneous impact with elastic vibration of high and low frequency, which in some cases may be very helpful.

Due to disadvantages listed above, the known method and device can be described as ones having low technical capabilities, which dramatically reduce efficiency of treatment of oil pool and do not allow increasing its productivity to required level.

SUMMARY OF THE INVENTION

The task that should be solved with this invention is development of such a device and such a method of its use, which (with minimum possible size of downhole apparatus) allow to process oil recovery on depths below 2000 meters and efficiently impact on treated pool e.g. treating in its well bottom zone and reservoir zone with boundaries in 1.5-2 and 150-200 meters from the well accordingly.

The solution in the invention has been achieved due to technical results which in process of oil recovery allow capability of treatment of oil pool with elastic vibrations of high and low frequency, provide in a discharge unit of downhole apparatus discharge voltage above 20 kV and discharge pulse with energy above 1 kJ.

The given task in the method of oil recovery with use of energy of elastic vibrations, including placing in a well on working depth of downhole apparatus, which is connected to aboveground power supply unit of industrial frequency and contains an ultrasonic transducer (14) that provides for the generation of high frequency elastic vibrations, exciting elastic vibrations of different frequencies and then repeatedly applying the elastic vibrations to the oil pool, IS ACHIEVED due to applying the elastic vibrations to the oil pool, is provided with high and/or low frequency vibrations and for production of elastic vibrations of high and low frequency with two independent sources of vibrations are used, one of which is designed as at least one emitting ultrasonic (as a rule—magnetostrictive) transducer and the second is based on electro pulse device, which provides elastic vibration of low frequency, is connected to an aboveground power supply of industrial frequency and comprises the following electrically interconnected components: a charger, a unit of energy storage capacitors (17), a discharge unit with electrodes, and two switching means, one of them provides grouping of separate energy storage capacitors in a single unit, while the second one carries out switching of capacitors from one method of their electrical connection to another, at the same time impact of high frequency elastic vibration is provided in low frequency ultrasonic range, mainly, on frequency of 18-44 kHz and applied in permanent or pulse regime with intensity in the range of 1-5 Wt/sm2, and impact of elastic vibrations of low frequency is provided with discharging pulses frequency equal to 0,2-0,01 Hz and the energy of single discharging pulse of 100-800 J, note that source of electric power applies to a charger constant voltage, in the range of 300-150 V, before charging capacitors they are grouped in one unit, charging is conducted mainly for parallel connection of capacitors and normally is carried out during 20 sec. up to required voltage, with the maximum one equal to 20-27 kV, and before discharging of the unit of energy storage capacitors, providing supply of output voltage on electrodes of discharging unit, all charging capacitors or part of them are switched to consequent electrical connection, at the same time impact of elastic vibration of low and high frequency is applied in turn or simultaneously, mainly, in fixed position of downhole apparatus, and is continued with permanent and/or changing electrical and acoustical characteristics of aboveground and/or in-well equipment and technological parameters of oil recovery process and, mainly, in course of permanent and/or periodical pumping out of oil from the well.

This is also helped with the following:

grouping of separate charging capacitors in the single unit and triggering of charging capacitors from one way of electrical connection to another is done mainly automatically;

magnitude of voltage applied to charging unit during process of charging of capacitors is set permanent and/or changing;

magnitude of voltage is changed smoothly or sharply;

magnitude of voltage is changed mainly to increase magnitude;

magnitude of voltage is changed at least once;

unit of charging capacitors consists of at least two capacitors;

unit of charging capacitors consists mainly of even number of capacitors;

unit of charging capacitors consists mainly of capacitors with electrical capacity of 0.5-3 microfarad and voltage of 20-30 kV;

unit of charging capacitors consists mainly of capacitors with the same and/or different technical characteristics grouping of the unit of charging capacitors at relevant stages is kept unchanged or is changed;

during charging of the unit of capacitors each capacitor is charged up to working voltage or at least up to 35%-50% of its magnitude during charging of the unit of capacitors each capacitor is charged to the same and/or different working voltage during charging of the unit of capacitors they are charged simultaneously or consequently;

in case of consequent charging capacitors are charged with time intervals or without them;

in case of charging with time intervals charging is done with the same or/and with different intervals;

interval duration is set in the range from 5 sec. to 10 min;

in course of discharge of capacitors they are discharged simultaneously and/or consequently;

in course of simultaneous discharge of capacitors all of them or only part of them are discharged;

in course of simultaneous discharge of part of capacitors at least two of them are discharged;

in course of consequent discharge of capacitors discharge is carried out with or without time intervals;

in course of discharge with time intervals discharge is carried out with the same and/or different time intervals;

duration of time interval is set in the range of 5-20 seconds;

in case of regime of pulse impact with elastic high frequency vibrations the duration of impact makes 0.1-0.5 seconds with pauses from 0.5 to 5 seconds.

The given task in the device realizing the method on point 1 including aboveground power supply of industrial frequency and, downhole apparatus having control unit, which is connected with electrical cable to aboveground power supply, is done in the format of empty cylindrical body, separated by partitions on hermetic sectors and contains the source of elastic high frequency vibrations, designed as emitting ultrasonic transducer, IS ACHIEVED due to the fact, that it is additionally provided with source of low frequency elastic vibrations, which is developed, mainly, on the basis of electro pulse device, connected to aboveground power supply of industrial frequency and placed in downhole apparatus, note that the source of high frequency elastic vibrations is designed as at least one ultrasonic, mainly, magnetostrictive transducer, and electro pulse device includes electrically connected charger, a unit of energy storage capacitors, a discharge unit with electrodes and two switching means, one of which at relevant stage of Work of downhole apparatus provides grouping of separate charging capacitors in one single unit, and the second provides in the unit of energy store capacitors switching of capacitors from their parallel connection to consequent connection and vise versa from consequent connection to parallel one, note that switching means are designed, mainly, as one single device, which is placed in the same frame with the unit of energy storage capacitors, and sections of downhole apparatus, in which the unit of energy store capacitors and source of high frequency elastic vibrations are situated, are filled with electro-insulating material.

This is also favored due to:

the module of downhole apparatus is filled mainly with electro-insulating material;

the module of downhole apparatus is filled with electro-insulating material in such a way that if downhole apparatus is situated vertically all parts in this section are dipped in electro-insulating material but in the module of the unit of energy storage capacitors there is some air cushion;

the volume of air cushion in the section is not less than 15% of volume of electro-insulating material;

the sections of downhole apparatus in which the unit of energy storage capacitors and source of high frequency elastic vibrations are situated, are filled with, mainly, the same electro-insulating material;

electro-insulating material is made of, mainly, heat-resistant organic-silicon fluid.

Figure 4:
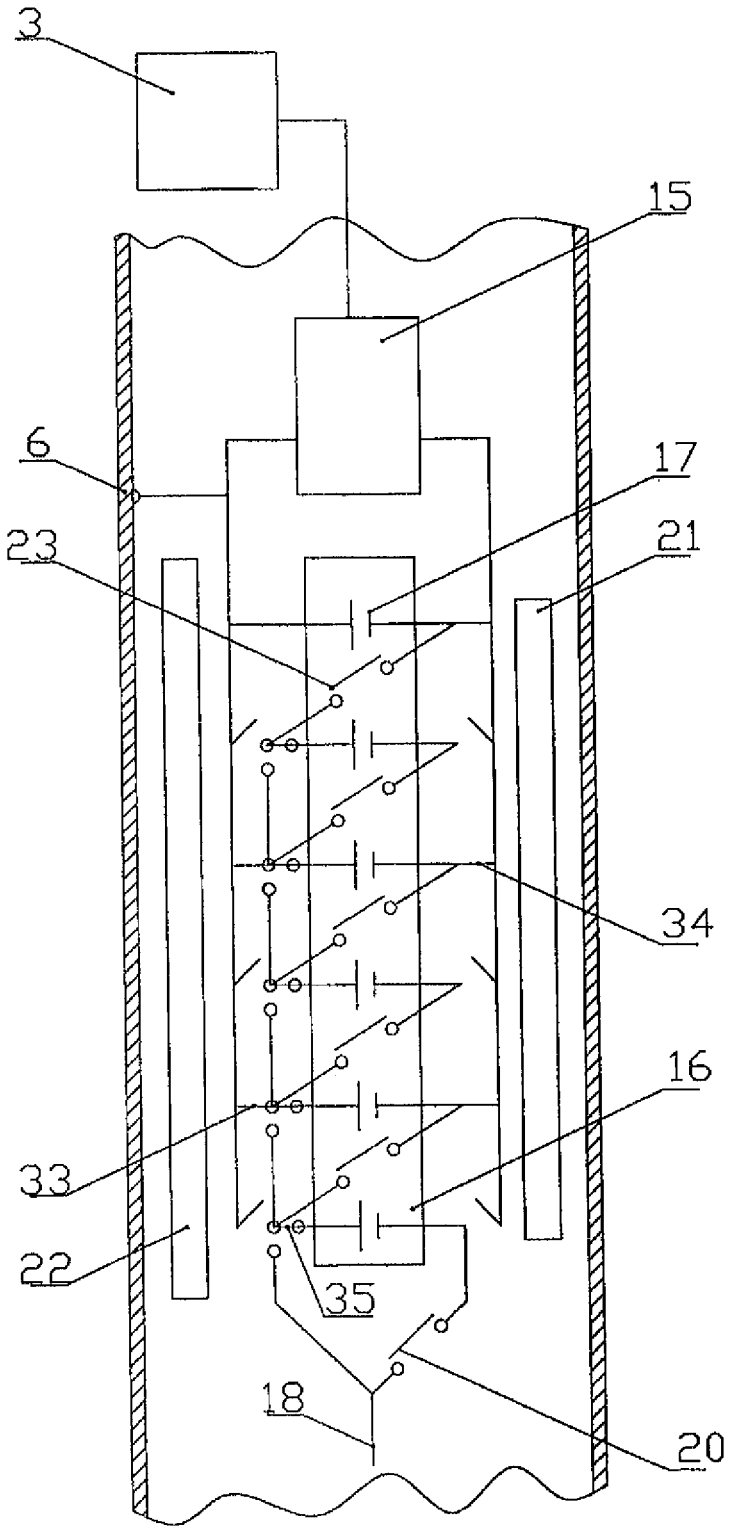
Figure 5:
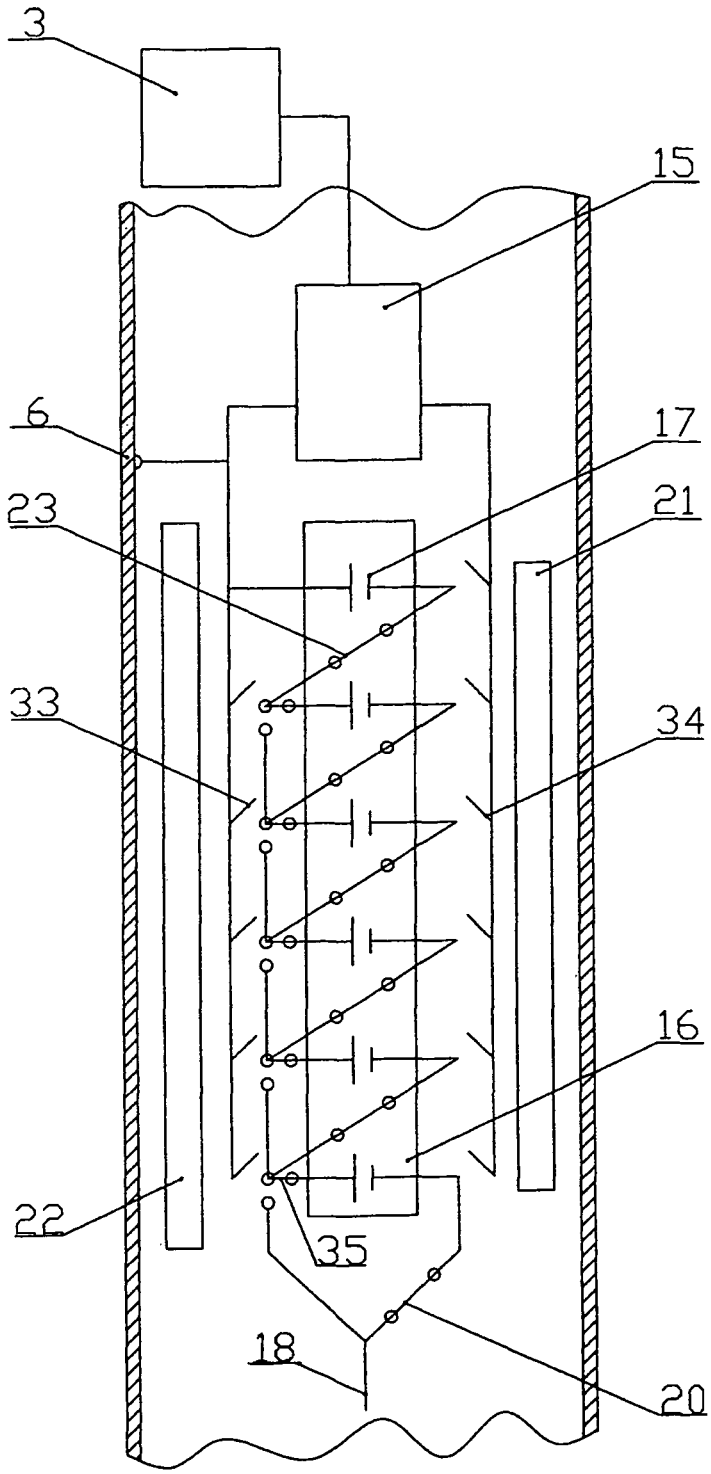
Figure 6:
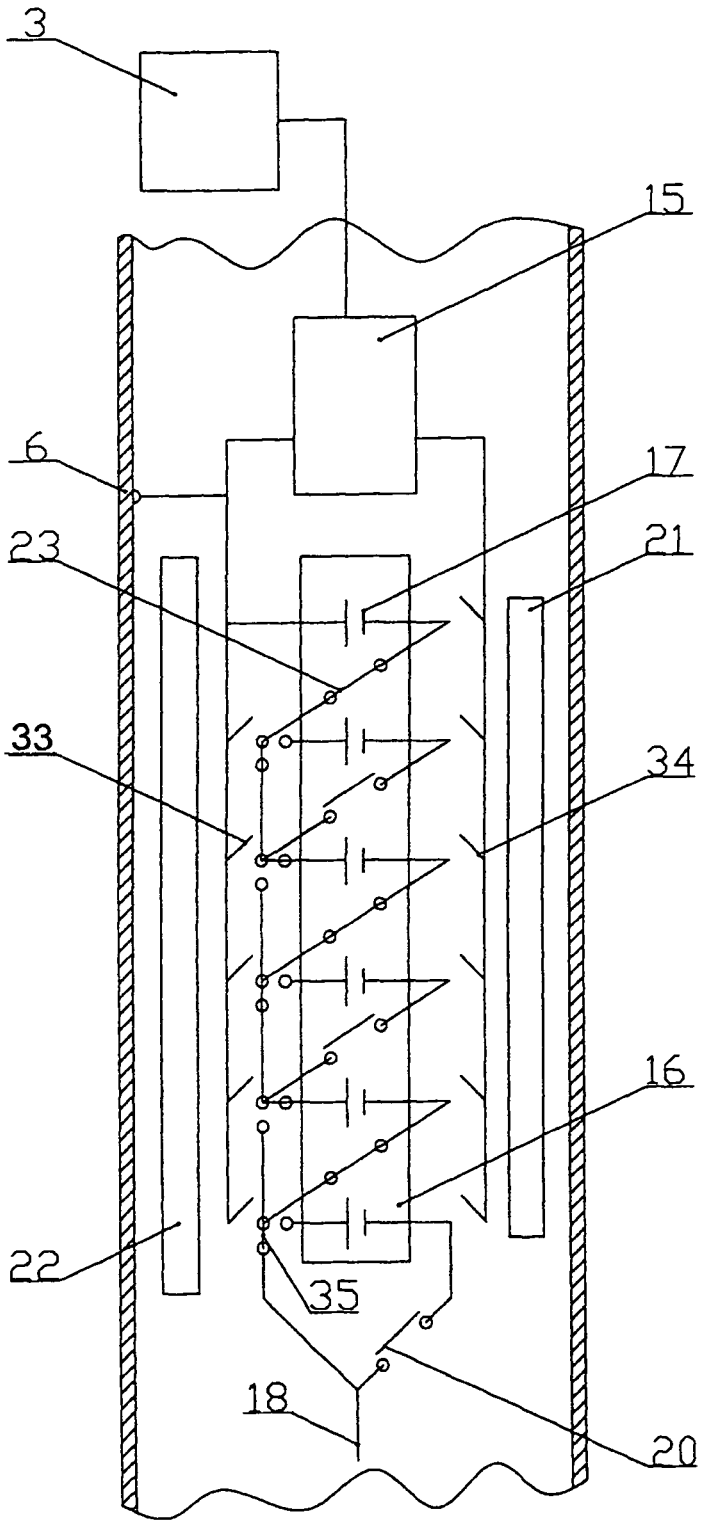
Figure 7:
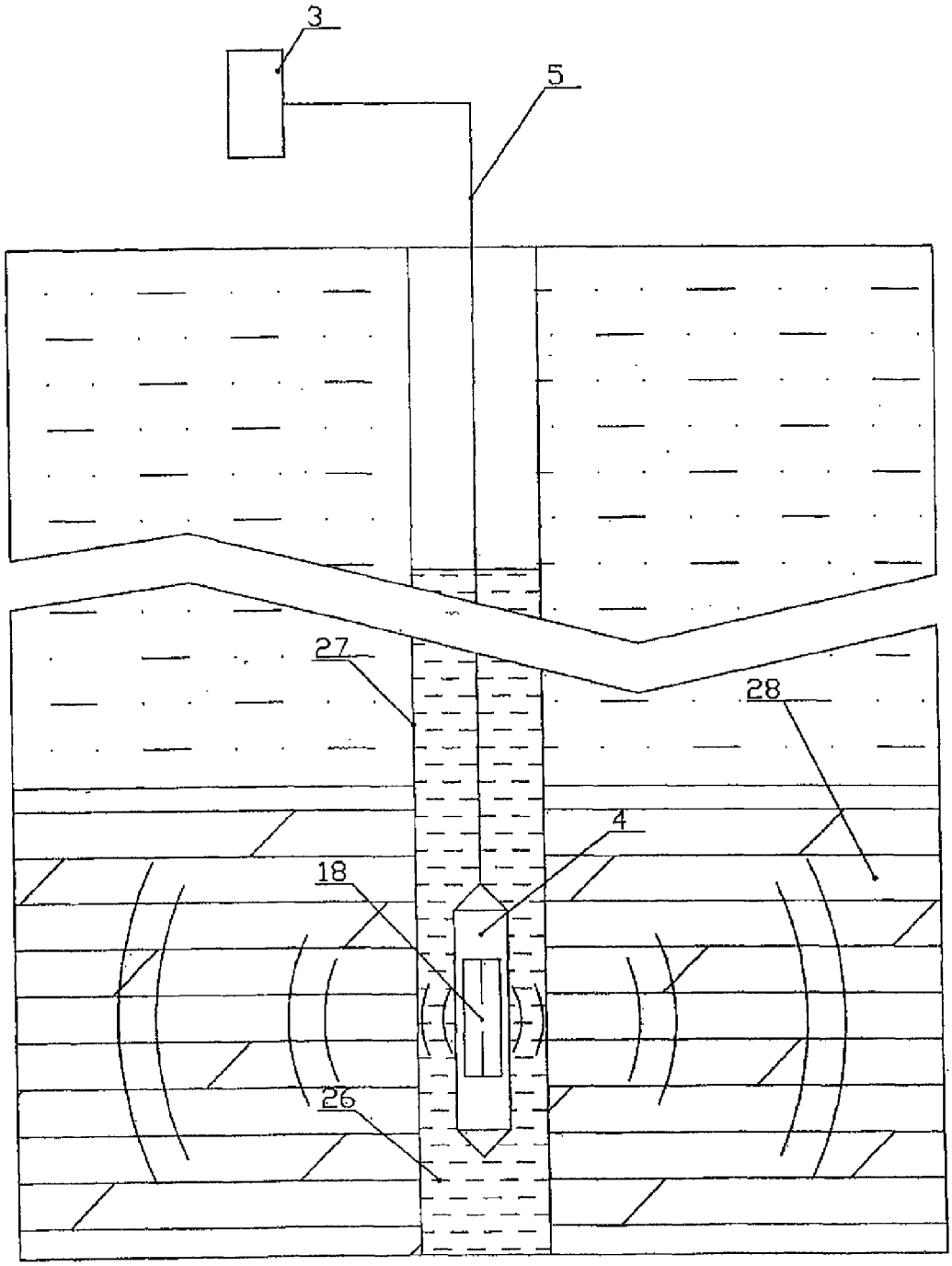

BRIEF DESCRIPTION OF THE DRAWINGS the proposed invention is explained with charts where the following parts are presented:

in FIG. 1—slit of downhole apparatus;

in FIG. 2—profile of the treated well in FIG. 3—slit of downhole apparatus at stage of grouping of the unit of energy storage capacitors from complete set of capacitors in FIG. 4—slit of downhole apparatus at stage of grouping of the unit of energy storage capacitors from non-complete set of capacitors in FIGS. 5 and 6—slit of downhole apparatus at stage of discharge of the unit of energy storage capacitors with different options of its grouping;

in FIG. 7—one of possible options for method realization.

DETAILED DESCRIPTION OF THE PREFERRED EMBODIMENTS

The device for oil recovery with use of energy of elastic vibrations of high and low frequency includes (see FIG. 1-3) two aboveground power supply units with control unit 1 and downhole apparatus 4 connected with cable 5 to power supply units 2 and 3, designed as empty cylindrical body 6 and separated by partitions 7, 8 and 9 into hermetical modules 10, 11, 12 and 13. Downhole apparatus 4 consists of source of high frequency elastic vibrations, which is connected to the power supply unit 2 and developed on the basis of magnetostrictive transducer, e.g. the one of circular type 14 and the source of low frequency elastic vibrations, developed on the basis of electro-pulse device. This electro-pulse device includes electrically connected in series charger 15, unit 16 of capacitors 17 and discharge unit with electrodes 18, 19 and the trigger 20, which may be designed e.g. as gas-filled discharger.

Unit 16 of capacitors is provided with two switching means 21, 22, which are connected to control unit 1, interconnected to power supply unit 3 and work automatically. First of them (equipped with switches 34) at relevant stages of work of downhole apparatus 4 provides (see FIGS. 3 and 4) grouping of separated capacitors 17 in a single unit 16. The second switching mean 22 (equipped with switches 33 and 35) at relevant stages of work of downhole apparatus 4 (together with switches 34 of first switching mean) provides in unit 16 of capacitors switching of separate capacitors 17 from parallel electrical connection (FIGS. 3 and 4) to series connection and vise versa. The switching mean 22 is designed, mainly, on basis of gas-filled dischargers 23, which together with switches 35 connect in series all energy storage capacitors 17.

Modules 11 and 12 of downhole apparatus 4, containing magnetostrictive transducer 14, unit 16 of capacitors 17 and switching means 21 and 22 are filled with insulating material 24, which is heat-resistant organosilicon fluid e.g. 'Penta—TPMS-110'. These modules are filled with insulating fluent in the way that the module of downhole apparatus is filled with electro-isolating material in such a way that if downhole apparatus 4 is situated vertically all parts in this module are dipped into insulating material. At the same time in the module 12 there is some air cushion (shown but not noted in FIG. 1), which volume is not less than 15% from volume of insulating fluid. Such insulating material and the option for filling of module 12 provide most favorable conditions for the work of parts mentioned above.

Module 13, containing electrodes 18 and 19 interconnected accordingly with output of the unit 16 of the capacitors 17 and with the body 6 of downhole apparatus 4 is designed with four transparent windows 25 providing access in the apparatus of oil-saturated fluid 26 (liquid treated media), which fills the well 27, which is provided with oil-well tubing 29 and oil pump with plunger 30, which is connected to pumping jack 31 with flexible element (not noted) and oil bars 32.

Below there are specific examples: production of low frequency elastic vibrations, production of high frequency elastic vibrations and realization of proposed method not excluding other ways of their execution in the claim of invention.

The laboratory research, allowed to determine workability of the proposed device of oil recovery and investigate claimed limitations for proposed method for oil recovering, was conducted with downhole apparatus (diameter 102 mm, length 3200 mm), which has been developed with the use of specifically produced energy storage capacitors (capacity 0.4-3 microfarad, working voltage from 10 to 20-30 kV) and circular magnetostrictive transducer (resonance frequency 24 kHz, intensity of emission 5 Wt/sm2), produced from the fusion 49K2F and having diameter of 84 mm and height of set of plates of 100 mm. The number of charging capacitors in the unit varied from two to six and part of capacitors before discharge were connected in groups of two capacitors.

First (see FIG. 2), the downhole apparatus 4 e.g. using oil-well tubing 29 is pulled down in the well 27 filled with fluid 26 (if required, working fluent is poured in the well) and place it in the area of expected impact on an oil pool requiring relevant treatment e.g. on the depth of 2700 meters. Due to this, body of module 13 of the downhole apparatus 4 through the windows 25 is filled with fluid 26. As a result electrodes 18 and 19 are completely deep into it.

Production of Low Frequency Elastic Vibrations (Option 1 Depth 2700 m)

Production of low frequency elastic vibrations is preceded with execution of the number of technological operations (regimes) interconnected (see FIGS. 3 and 5) with grouping of separated capacitors in one unit including charging the unit of capacitors, switching of capacitors from one type of electrical connection to another and followed by discharge of the unit of capacitors done e.g. automatically which is more rational than manual control (which however is also possible).

Regime 'Grouping of Charging Capacitors in One Unit'.

On the command from control unit 1 aboveground power supply unit 3 is connected to industrial electrical power grid (voltage 220 V, frequency 50 Hz) and switching means 21 and 22, gas-filled dischargers 23 and trigger 20 are connected (not shown in figures) with the point of power supply unit 3, which supplies working voltage of 220 V. As a result, electrical switches 33, 34 and 35 of switching means and make contacts (in FIG. 3-6 are in bold) of gas-filled dischargers 23 and the trigger 20 are switched in initial (open) position. On second command from control unit 1 (done simultaneously or consequently) on switching means 21 and 22, electrical switches 33, 34 and 35 connect six charging energy storage capacitors 17 included in the downhole apparatus 4 with electrical chain (attached to the body 6 of the downhole apparatus) of charger 15 providing (see FIG. 3) their parallel electrical connection and completing their grouping in one unit 16. All six charging capacitors 17 have the same technical characteristics (capacity—1.7 microfarad, working voltage—12.5 kV).

It should be noted that the unit of charging capacitors^

Is grouped from at least two capacitors

Is grouped, mainly, from even number of capacitors

Depending on number of capacitors included in the set of downhole apparatus and real working conditions of downhole apparatus, can be grouped from capacitors with the same and/or different technical characteristics, note that initial grouping of unit of charging capacitors at relevant stages of work of electro-pulse device can be easily changed automatically in different ways.

Regime 'Charging of Unit of Energy Storage Capacitors'.

When energy storage capacitors are grouped in one unit 16 on according command from control unit 1 (see FIG. 3) charger 15 is connected to the point (switched on by the same command) of power supply unit 3, which transforms industrial voltage of electrical network in DC voltage (the range 300-150 V) and by cable 5 is transmitted to charging unit 15 providing option of simultaneous charging to the same magnitude of all six charging capacitors 17. As a result, DC voltage e.g. 250 V is applied to charging capacitors and their charging to required magnitude is carried out. For charging duration of 10 sec. all charging capacitors 17 are completely charged to their (12.5 kV) working voltage.

It should be noted that in course of charging of the unit of charging capacitors:

magnitude of voltage applied to charger can be changed and this can be done gradually or in jump towards its increase at least once;

capacitor is charged not less than to 35-50% from the magnitude of its working value;

capacitors can be charged to different extent capacitors can be charged in series (one by one), note that for series charging it can be done without time intervals or with intervals setting the same or different duration in the range of 5 sec.-10 min.

optimal duration of charging makes 10-20 sec.

Regime 'Discharging of Unit of Energy Storage Capacitors'.

When charging of unit 16 of charging capacitors 17 is completed in accordance with corresponding commands (see FIG. 4) from control unit 1, communicated (simultaneously or consequently) to charger 15 and switching means 21 and 22, charger 15 is switched out from power supply unit 3 and electrical switches 33 and 34 of switching means 21 and 22 switch capacitors 17 in their in series electrical connection. Then from control unit 1 to trigger 20 of discharging unit comes the command for electrical connection of unit 16 of charging capacitors with electrodes 18 and 19, one of which (18) is connected to the trigger 20 and the other (19) is connected to body 6 of downhole apparatus 4.

As a result of such connection discharging of unit of charging capacitors 16 takes place providing supply of output voltage (breakdown voltage) to electrodes 18 and 19 of discharging unit. Magnitude of such breakdown voltage is proportional to number of charging capacitors and is equal to the sum voltages charged by each of them and for the parameters mentioned above makes 75 kV. When such output voltage from the unit of charging capacitors is supplied to electrodes 18 and 19 deep in oil-saturated fluid 26, between electrodes the single electrical discharge takes place, which energy is 800 J and which, on mentioned depth, is sufficient for efficient impact on critical area of the pool in distance of 180-200 meters from downhole apparatus.

It should be noted that during discharge of the unit of charging capacitors in case of simultaneous discharging one can discharge not all capacitors but only part of them (at least two)

capacitors can be discharged one by one; in this case discharging may be carried out without time intervals or with such intervals setting for them the same or different duration in the range of 5-20 seconds.

The discharge causes significant movements of the fluid following in development of cavity pockets, which then are closed. Single electrical discharge causes water hammer consisting of two water hammers: first one when fluid is pulled out and the cavity one occurring when pocket is closed. The more density of the fluid (more powerful pulse and the higher amplitude) is the higher pressure of electro-water hammer is.

When hydraulic impact of first single electrical discharge on fluid 26 (filling module 13 and the well 27) and accordingly on receiver part of well, all equipment and devices (on corresponding command from control unit) is switched into initial condition (energy supply unit 3 is not disconnected from industrial network) and is ready again to consequent execution of such regimes of work as 'Grouping of charging capacitors in one unit' and 'Discharging of the unit of charging capacitors', Multiple execution of these regimes of work (possibly with other electrical parameters) leads to development in the fluid of second and so on single electrical discharges, normally with frequency of 0.2-0.01 Hz (for parameters mentioned above –0.03 Hz).

In course of works on different depth other options for production of low frequency elastic vibrations listed below can be implemented.

Production of low frequency elastic vibrations (Option #2. Depth is 2000 m)

Regime 'Grouping of Charging Capacitors in One Single Unit'.

Unit of capacitors—totally 6. Used for work—–4 capacitors. The capacitors have the same technical characteristics. Electrical capacity—1.0 microF, Working voltage—25 kV.

Regime 'Charging of the Unit of Charging Capacitors'.

Voltage—220 V. Magnitude of voltage is constant. Capacitors are charged up to working voltage. Capacitors are charged simultaneously. Duration of charging—10 seconds Regime 'Discharging of the Unit of Charging Capacitors'.

Before discharging, capacitors are grouped in two groups by two capacitors, Capacitors are discharged simultaneously. Breakdown voltage is 50 kV. Energy of discharge is 500 J. Impact on the critical area at distance of 140-160 meters. Frequency of discharges is 0.03 Hz.

Production of low frequency elastic vibrations (Option #3. Depth is 1700 m)

Regime 'Grouping of Charging Capacitors in One Single Unit'. (see FIG. 4) Unit of capacitors—totally 6. Used for work—–3 capacitors. The capacitors have the same technical characteristics. Electrical capacity—1.0 microF. Working voltage—25 kV.

Regime 'Charging of the Unit of Charging Capacitors'. (see FIG. 4)

Voltage—180 V. Capacitors are charged up to 56% of working voltage. Capacitors are charged simultaneously. Duration of charging—10 seconds Regime 'Discharging of the Unit of Charging Capacitors' (see FIG. 6).

Before discharging, capacitors are not grouped. Capacitors are discharged simultaneously. Breakdown voltage is 40 kV. Energy of discharge is 300 J. Impact on the critical area at distance of 80-100 meters. Frequency of discharges is 0.03 Hz.

Production of low frequency elastic vibrations (Option #4. Depth is 2200 m)

Regime 'Grouping of Charging Capacitors in One Single Unit'.

Unit of capacitors—totally 6. Used for work—6 capacitors (A, B, C, D, E, F). The capacitors (A-F) have different technical characteristics. Electrical capacity: (A and B)—0.5 microF, (C and D)—1.0 microF, (E and F)—1.5 microF. Working voltage: (A and B)—14 kV; (C and D)—20 kV, (E and F)—22 kV. The capacitors are grouped in three groups: (A and B), (C and D), (E and F).

Regime 'Charging of the Unit of Charging Capacitors'.

Voltage: (A and B)—170 V, (C and D)—180 V, (E and F)—190 V. Magnitude of voltage is changed in a jump. Capacitors are charged up to working voltage. Groups of capacitors are charged consequently (one by one): e.g. first (A and B) then (C and D) and then (E and F). Between charging of groups there are the same time intervals of 10 seconds. Duration of charging: (A and B)—10 seconds, (C and D)—15 seconds, (D and E)—20 seconds Regime 'Discharging of the Unit of Charging Capacitors'.

Groups of capacitors are discharged consequently (one by one): e.g. first (A and B) then (C and D) and then (E and F). Between discharging of groups there are the same time intervals of 20 and 10 seconds. For discharging of the group (A and B): breakdown voltage is 28 kV; energy of discharge is 100 J; impact on the critical area at distance of 40-50 meters. For discharging of the group (C and D): breakdown voltage is 40 kV; energy of discharge is 400 J; impact on the critical area at distance of 100-120 meters. For discharging of the group (E and F): breakdown voltage is 44 kV; energy of discharge is 700 J; impact on the critical area at distance of 160-180 meters.

In general for options 1-4 treatment of critical area of the well with elastic vibrations of low frequency on noted depths with noted parameters may (see FIG. 7) be performed permanently during all overhaul life of the well or it can be performed as follows:

cycle of impact with elastic vibrations during 5-10 min;

cycle of technological break during 5-15 min;

repeated cycle (2-5 times) of impact and break recovery of oil-saturated fluid from the well After completion of all works with production and use of elastic low frequency vibrations electro-pulse device is switched off from the power supply unit 3, which is disconnected from industrial electrical network.

Production of elastic high frequency vibrations of low frequency ultrasonic range.

On first command from control unit 1 aboveground power supply unit 2 (see FIG. 2 and), which is ultrasonic generator e.g. PS 4-25 connected to industrial electrical network, on second command it starts transforming electrical energy of industrial frequency (50 Hz) in energy of AC voltage of ultrasonic frequency (working frequency of 23-26 kHz) and transmits it by cable 5 on toxoid energizing coil (shown but not noted in FIG. 1) of circular magnetostrictive transducer 14. Under influence of magnetic field created by energizing coil transducer 14 starts radial vibrations with amplitude of 2-5 microns, which via insulating material 24 and walls of the body 6 of downhole apparatus 4 are transmitted to fluid 26 filling the well 27 and its critical area. Under influence of these vibrations of fluid filtration properties of critical area are improved and stabilized, which leads to increase of productivity of treated oil pool.

Impact by elastic vibrations of high frequency is performed mainly on frequency 18-44 kHz and is continued in constant or pulse regime with intensity in the range of 1-5 Wt/sm2.

It should be noted that depth of placement of transducer does not have negative impact on efficiency of production of high frequency vibrations and also it should be noted that in case of pulse impact by high frequency elastic vibrations duration of impact makes 0.1-0.5 seconds and duration of break makes 0.5-5 seconds.

Generally treatment of critical area of the well with elastic vibrations of high frequency on the depths noted above with parameters noted above can be done e.g. as follows:

initial intensity of vibrations—1.2 Wt/sm2;

duration of treatment—5 minutes;

technological break of 5 minutes increase (performed from control unit 1) of intensity of vibrations—2.5 Wt/sm2;

duration of treatment—20 minutes technological break during 10 minutes three cycles of treatment with duration of 10 minutes per each with two technological breaks of 5 minutes each.

After completion of all works with production and use of elastic high frequency vibrations of low frequency ultrasonic range magnetostrictive transducer is switched off from the power supply unit 2, which is disconnected from industrial electrical network.

It should be noted that maximum efficiency from realization of proposed method is achieved in case when oil-saturated fluid 28 is pumped out from treated well e.g. with oil pump 30, pumping jack 31, oil bars 32 and oil-well tubing 29. Note that pumping out of the fluid can be started before impact on the pool by elastic vibrations.

Comparative analysis of known and proposed technical solutions indicates significant advantages of the latter. First, it is capability to impact on oil pool with elastic vibrations of both high and low frequency and accordingly treatment of not only well bottom zone but also treatment of critical area of the pool. Second, it is the capability to work on depths of 1500-2700 meters and more with optimal regimes of treatment and opportunities for broad variations of electro-technical parameters of downhole apparatus with simultaneous impact on oil pool with elastic vibrations of both high and low frequency. Third, this is rather small size of downhole apparatus (in comparison with first analogue: diameter is 2.5 times less, length is 1.04 times shorter), which allows using of it in wells of any profile of inclines of sections of pool with quick movements from well to well.

Sources of information take into consideration in course of development of the invention specification and claim:

1. RF patent #2 283 951 'Electro-hydraulic pulse device.', 2006

2. RF patent #2 026 969, 'The approach for acoustic impact on critical area of a pool', 1995

3. RF patent #2 162 519 'The approach fro acoustic treatment of critical area of a well and device for its realization', 2001

The invention claimed is:

1. A method for oil recovery with use of energy of elastic vibrations including placement of downhole apparatus in a well on working depth, which is connected to aboveground power supply units and contains an ultrasonic transducer that provides for the generation of high frequency elastic vibrations, exciting elastic vibrations of different frequencies and then repeatedly applying the elastic vibrations to the oil formation (pool), wherein impact on oil pool is done with both high and low frequency vibrations, wherein the low frequency vibrations are generated with the aid of an electric pulse device which is connected to an aboveground power supply and comprises the following electrically interconnected components: a charger, a unit of energy storage capacitors, a discharge unit with electrodes, and two switching means, one of which provides grouping of charging capacitors in one single unit and the second carries out switching of charging capacitors from one type of electrical connection to another, wherein impact with high frequency elastic vibrations is performed in low frequency ultrasonic range, and is continued in constant or pulse regime with intensity in the range of 1-5 $Wt/sm^2$ while impact with elastic vibrations of low frequency is performed with frequency of charges equal to 0.2-0.01 Hz and is continued with energy of single impact of discharge making 100-800 J, wherein the charger is supplied from power supply unit with DC voltage with magnitude in the range 300-150 V, before charging of capacitors they are grouped in one single unit, charging of unit of energy store capacitors is executed at least partially with parallel connection and is continued up to required magnitude of voltage, with maximum magnitude equal to 20-27 kV, and before discharging of unit of energy storage capacitors providing supply of output voltage on electrodes and of discharging unit, all charging capacitors or part of them are switched into series electrical connection, together with this impact with elastic vibrations of low and high frequency is performed, continued with constant or varying electrical and acoustical characteristics of aboveground or in-well equipment and technological parameters of oil recovery process.

2. The method according to claim 1, wherein grouping of separated charging capacitors in one single unit and switching of capacitors from one type of electrical connection to another is done automatically.

3. The method according to claim 1, wherein the magnitude of voltage supplied to charger during process of charging of unit is set permanent or changing.

4. The method according to claim 3, wherein the magnitude of voltage is changed smoothly or sharply.

5. The method according to claim 3, wherein magnitude of voltage is changed towards its increase.

6. The method according to claim 3, wherein magnitude of voltage is changed at least once.

7. The method according to claim 1, wherein the unit of energy store capacitors is grouped from at least two capacitors.

8. The method according to claim 1, wherein the unit of energy store capacitors is grouped from even number of capacitors.

9. The method according to claim 1, wherein the unit of energy store capacitors is grouped from capacitors having electrical capacity of 0.5-3 microfarad and magnitude of voltage is in the range of 20-30 kV.

10. The method according to claim 1, wherein the unit of energy store capacitors is grouped from capacitors with the same or different technical characteristics.

11. The method according to claim 1, wherein grouping of the unit of energy store capacitors at relevant stages of work of electro-pulse device is the same or is changed.

12. The method according to claim 1, wherein in course of charging of the unit of energy store capacitors the capacitors are charged up to working voltage or at least up to 35-5% of its magnitude.

13. The method according to claim 1, wherein in course of charging of the unit of energy store capacitors the capacitors are charged up to the same or different working voltage.

14. The method according to claim 1, wherein in course of charging of the unit of energy store capacitors the capacitors are charged simultaneously or sequentially (one by one).

15. The method according to claim 14, wherein for sequential charging energy storage capacitors are charged with time intervals or without them.

16. The method according to claim 15, wherein for charging with time intervals, charging is done with the same or different time intervals.

17. The method according to claim 15, wherein time interval duration is set in the range from 5 seconds to 10 minutes.

18. The method according to claim 1, wherein in course of discharging of the unit of energy store capacitors the capacitors are discharged simultaneously or sequentially (one by one).

19. The method according to claim 18, wherein in course of simultaneous discharging of energy store capacitors all capacitors of the unit are discharged or just part of them.

20. The method according to claim 18, wherein in course of simultaneous discharging of energy store capacitors discharging is done with or without time intervals.

21. The method according to claim 20, wherein in course of discharging with time intervals discharging is done with the same or different intervals.

22. The method according to claim 20, wherein duration of time interval is set in the range of 5-20 seconds.

23. The method according to claim 1, wherein in course of simultaneous discharging of part of energy store capacitors at least two capacitors are discharged.

24. The method according to claim 1, wherein for pulse regime of impact of elastic vibrations of high frequency duration of impact makes 0.1-0.5 seconds and duration of pause is from 0.5 to 5 seconds.

25. The device for practicing the method according to claim 1, wherein the device includes aboveground power supply units and downhole apparatus provided with control unit, which by electrical cable is connected to aboveground power supply units, designed as empty cylindrical body and separated by partitions into hermetical modules and contains source of elastic vibrations of high frequency designed as ultrasonic transducer wherein it additionally contains source of low frequency elastic vibrations, which developed on basis of electro-pulse device connected to aboveground power supply and placed in downhole apparatus, wherein electro-pulse device contains electrically interconnected charger unit of energy storage capacitors, discharging unit with electrodes a and two switching means an, one of which provides grouping of charging capacitors in of energy storage capacitors switching of capacitors from parallel connection to the series one and vice versa from series connection to the parallel one, wherein switching means are designed as one device, which is placed in one module with the unit of energy storage capacitors and modules and of downhole apparatus which contain unit of energy storage capacitors and source of elastic vibrations of high frequency are filled with electro-insulating material.

26. The device according to claim 25, wherein the module of downhole apparatus is filled with electro-insulating material in the way that if downhole apparatus is situated vertically, all parts in the module mentioned above are completely deep into electro-insulating material but in the module containing unit of energy storage capacitors there is some air cushion.

27. The device according to claim 26, wherein the volume of air cushion in the module makes at least 15% of volume of electro-insulating material.

* * * * *

UNITED STATES PATENT AND TRADEMARK OFFICE

CERTIFICATE OF CORRECTION

PATENT NO. : 9,004,165 B2
APPLICATION NO. : 13/266491
DATED : April 14, 2015
INVENTOR(S) : Abramova et al.

It is certified that error appears in the above-identified patent and that said Letters Patent is hereby corrected as shown below:

In the Claims

In Column 11, line 34 (Line 32 in Claim 1), after “electrodes” please delete: “and”.

In Column 12, line 57 (Line 13 in Claim 25), after “electrodes” please delete: “a”.

In Column 12, line 58 (Line 14 in Claim 25), after “means” please delete: “an”.

In Column 12, line 59 (Line 15 in Claim 25), after “in” please insert: --one single unit and the second carries out in the unit--.

Signed and Sealed this
Eighteenth Day of August, 2015

Michelle K. Lee

Michelle K. Lee
*Director of the United States Patent and Trademark Office*